US010153585B1

(12) United States Patent
Zhu et al.

(10) Patent No.: US 10,153,585 B1
(45) Date of Patent: Dec. 11, 2018

(54) ANTI-SHEDDING POWER CABLE PLUG

(71) Applicants: Xiaoping Zhu, Dongguan (CN); Yanlin Wang, Dongguan (CN)

(72) Inventors: Xiaoping Zhu, Dongguan (CN); Yanlin Wang, Dongguan (CN)

( * ) Notice: Subject to any disclaimer, the term of this patent is extended or adjusted under 35 U.S.C. 154(b) by 0 days.

(21) Appl. No.: 15/884,377

(22) Filed: Jan. 31, 2018

(51) Int. Cl.

| | |
|---|---|
| ***H01R 4/66*** | (2006.01) |
| ***H01R 13/648*** | (2006.01) |
| ***H01R 13/627*** | (2006.01) |
| ***H01R 24/22*** | (2011.01) |
| ***H01R 13/639*** | (2006.01) |
| ***H01R 13/58*** | (2006.01) |
| *H01R 103/00* | (2006.01) |

(52) U.S. Cl.
CPC ..... *H01R 13/6271* (2013.01); *H01R 13/582* (2013.01); *H01R 13/639* (2013.01); *H01R 24/22* (2013.01); *H01R 2103/00* (2013.01)

(58) Field of Classification Search
CPC ..... H01R 13/6271; H01R 13/582; H01R 13/639; H01R 24/22; H01R 13/6582; H01R 13/648; H01R 2103/00; H01R 13/65802; H01R 13/652
See application file for complete search history.

(56) References Cited

U.S. PATENT DOCUMENTS

| | | | | |
|---|---|---|---|---|
| 7,008,255 | B1 * | 3/2006 | Wang | H01R 13/506 439/357 |
| 7,588,451 | B2 * | 9/2009 | Chen | H01R 13/701 439/265 |
| 8,840,418 | B2 * | 9/2014 | Chien | H01R 13/6392 439/270 |

* cited by examiner

*Primary Examiner* — Xuong Chung Trans
(74) *Attorney, Agent, or Firm* — Wayne & King LLC

(57) ABSTRACT

The present invention discloses an anti-shedding power cable plug, comprising a power cable and a plug body. The plug body includes a hollow housing, the housing includes a lower housing and an upper housing, and the housing accommodates a lock insert and conductive pins. The lock insert includes an inner sleeve, a stepped groove is arranged in the middle of the inner sleeve, a supporting protrusion is arranged on the outer side of the stepped groove, a first rotating hole is arranged transversely on the inner side of the stepped groove. In the present invention, the anti-shedding hook enables the power cable plug to be locked on the socket, thereby preventing the power cable from shedding during use so as to improve the reliability.

6 Claims, 11 Drawing Sheets

ANTI-SHEDDING POWER CABLE PLUG

TECHNICAL FIELD

The present invention relates to the field of electronic information equipment and electrical appliances, and particularly relates to an anti-shedding power cable plug.

BACKGROUND OF THE PRESENT INVENTION

Power cable plugs are used in various fields. The general power plugs can be used as long as being connected to the power cable. According to various purposes of the power plugs, the power cable s can be used under the voltages of 250V, 125V and 36V, and under various currents such as 16 A, 13 A, 10 A, 5 A and 2.5 A.

In the prior art, the power cable plug is usually used by means of directly fixing the conductive pins to the housing. Such a power cable plug may easily fall off due to pulling and may affect the normal use of the equipment during use. At the same time, as time goes on, the two conductive pins will heavily wear, so that the power cable plug is more likely to loose and fall off when being plugged into the socket.

Therefore, the prior art still needs to be improved and developed.

SUMMARY OF PRESENT INVENTION

The technical problem to be solved by the present invention is to provide an anti-shedding power cable plug according to the above defects of the prior art. The present invention aims to solve the problem that the power cable plug of the prior art is easily loosened off during use, thus affecting the normal use of equipment.

The technical scheme adopted by the present invention is as follows:

An anti-shedding power cable plug, the anti-shedding power cable plug includes:

a power cable, and a plug body connected to one end of the power cable.

The plug body includes a hollow housing, the housing includes a lower housing and an upper housing covered with the lower housing, the housing accommodates a lock insert and conductive pins disposed on both sides of the lock insert.

The lock insert includes an inner sleeve, a stepped groove is arranged in the middle of the inner sleeve, a supporting protrusion is arranged on the outer side of the stepped groove, a first rotating hole is arranged transversely on the inner side of the stepped groove. The first rotating hole is sheathed with a rotating shaft, the inner sleeve is sheathed with a ground pin, the ground pin is supported by the supporting protrusion. The ground pin is provided with anti-shedding hooks on its left and right sides, one end of the anti-shedding hook is sheathed on the rotating shaft, the inner sleeve is provided with a semicircular groove on each side wall adjacent to the two anti-shedding hooks, the two semicircular grooves accommodate a first return spring, the first return spring is pressed under the anti-shedding hooks.

A button groove is arranged at a joint of the upper housing and the lower housing, and the button groove accommodates a key and a second return spring which is pressed under the key.

Preferably, in the anti-shedding power cable plug, one end of the housing that connected to the power cable is provided with a strain relief.

Preferably, in the anti-shedding power cable plug, the anti-shedding hook includes an anti-shedding hook body, a second rotation hole transversely disposed on the lock hook body, and an anti-shedding hook protrusion arranged on the upper surface of the front end for the anti-shedding hook body.

The axis of the second rotation hole coincides with the axis of the first rotation hole.

Preferably, in the anti-shedding power cable plug, the second rotation hole is disposed at the rear end of the hook body, the axis of the second rotation hole is higher than the highest point of the anti-shedding hook protrusion.

Middle portion of the upper surface of the anti-shedding hook body is prominently provided with a first load-bearing position, and a second load-bearing position is provided on a lower surface of the anti-shedding hook body corresponding to the first load-bearing position. One end of the upper surface for the anti-shedding hook body that adjacent to the second rotation hole is provided with a third load-bearing position, and a fourth load-bearing position is disposed on the left side of the second load-bearing position.

Preferably, in the anti-shedding power cable plug, the second rotating hole is disposed at the middle portion of the upper surface for the anti-shedding hook body, a fifth load-bearing position is disposed on the upper and lower surfaces of the rear end portion for the anti-shedding hook body, and a sixth load-bearing position is arranged on the left side of the second rotation hole.

Preferably, in the anti-shedding power cable plug, the second rotation hole is disposed at the rear end of the hook body, the second rotation hole and the anti-shedding hook protrusion are respectively arranged on the upper and lower sides of the anti-shedding hook body.

Comparing with the prior art, the anti-shedding power cable plug provided by the present invention includes a power cable and a plug body connected to one end of the power cable. The plug body includes a hollow housing, the housing includes a lower housing and an upper housing covered with the lower housing, and the housing accommodates a lock insert and conductive pins disposed on both sides of the lock insert. The lock insert includes an inner sleeve, a stepped groove is arranged in the middle of the inner sleeve, a supporting protrusion is arranged on the outer side of the stepped groove, a first rotating hole is arranged transversely on the inner side of the stepped groove. The first rotating hole is sheathed with a rotating shaft, the inner sleeve is sheathed with a ground pin, the ground pin is supported by the supporting protrusion. The ground pin is provided with an anti-shedding hook on its left and right sides, one end of the anti-shedding hook is sheathed on the rotating shaft, the inner sleeve is provided with a semicircular groove on each side wall adjacent to the two anti-shedding hooks, the two semicircular grooves accommodate a first return spring, the first return spring is pressed under the anti-shedding hooks. A button groove is arranged at a joint of the upper housing and the lower housing, and the button groove accommodates a key and a second return spring which is pressed under the key. The anti-shedding hook enables the power cable plug to be locked on the socket, thereby preventing the power cable from shedding during use so as to improve the reliability.

DETAILED DESCRIPTION OF PREFERRED EMBODIMENTS

Figure 1:
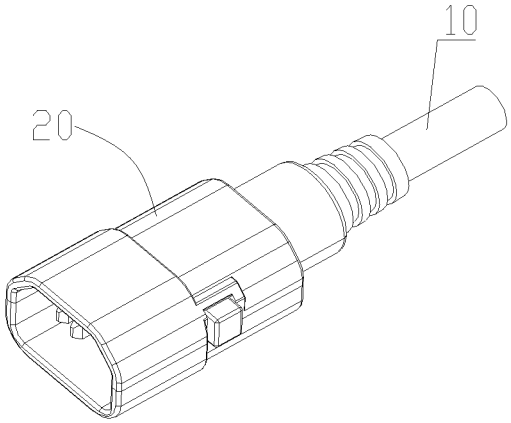
FIG. 1 is a three-dimensional structural schematic diagram of a preferred embodiment of the anti-shedding power cable plug according to the present invention.

In order that the objectives, technical schemes and advantages of the present invention will become more apparent, the present invention will be described in more detail with reference to the drawings and embodiments. It should be understood that the specific embodiments described herein are only for illustrating but not for limiting the present invention.

The present invention provides an anti-shedding power cable plug as shown in FIG. 1 to FIG. 10, comprising a power cable 10 and a plug body 20 connected to one end of the power cable 10. The plug body 20 includes a hollow housing 100, the housing 100 includes a lower housing 101 and an upper housing 102 covered with the lower housing 101, and the housing 100 accommodates a lock insert 200 and conductive pins 300 disposed on both sides of the lock insert 200. The lock insert 200 includes an inner sleeve 201, a stepped groove 211 is arranged in the middle of the inner sleeve 201, a supporting protrusion 221 is arranged on the outer side of the stepped groove 211, a first rotating hole 231 is arranged transversely on the inner side of the stepped groove 211. The first rotating hole 231 is sheathed with a rotating shaft 241, the inner sleeve 201 is sheathed with a ground pin 202, the ground pin 202 is supported by the supporting protrusion 221. The ground pin 202 is provided with an anti-shedding hook 251 on its left and right sides, one end of the anti-shedding hook 251 is sheathed on the rotating shaft 241, the inner sleeve 201 is provided with a semicircular groove 261 on each side wall adjacent to the two anti-shedding hooks 251, the two semicircular grooves 261 accommodate a first return spring 271, the first return spring 271 is pressed under the anti-shedding hooks 251. A button groove 203 is arranged at a joint of the upper housing 101 and the lower housing 102, and the button groove 203 accommodates a key 213 and a second return spring 223 which is pressed under the key 213.

In practice, the lock insert 200 is mainly used for fixing the anti-shedding hook 251. The first return spring 271 pressed under the anti-shedding hook 251 and the second return spring 223 pressed under the key 213 are used for resetting anti-shedding hook 251 and key 213 respectively. The rotating shaft 241 is mainly used for allowing the two anti-shedding hooks 251 to rotate on the rotating shaft 241, such that the anti-shedding hooks 251 will protrude from the surface of the ground pin 202 so as to stick the plug, thus effectively preventing the plug from shedding. When the key 213 is pressed, the first return spring 271 will be compressed, so that the highest point of the anti-shedding hook 251 will locate on the surface of the ground pin 202. Two buckles are further arranged on the side adjacent to the semicircular groove 261, and the two buckles are used to hold the anti-shedding hooks 251.

Therefore, operation of the anti-shedding power cable plug can be divided into two actions. One is anti-shedding: Once the power cable is inserted into the socket, the anti-shedding hook 251 and the rotating shaft 241 will swing, and they can return to the initial position by the reset function of the first return spring so as to lock the power cable plug and prevent it from shedding. The second is unanti-shedding: When the power cable is required to be unplugged, press and hold the key 213 to unlock and unplug the power cable from the socket.

In a further preferred embodiment of the present invention, one end of the housing 100 that connected to the power cable 10 is provided with a strain relief 30.

Figure 8:
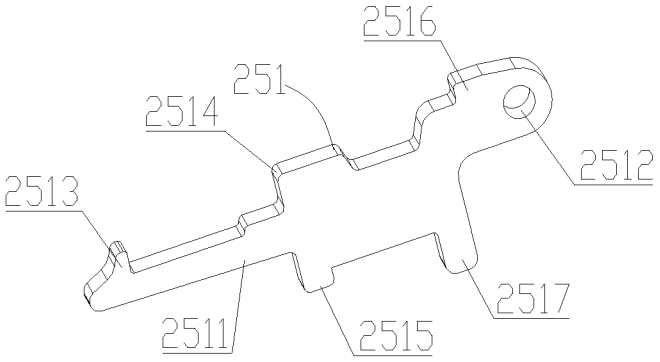
FIG. 8 is a structural schematic diagram of a preferred embodiment of the anti-shedding hook for the anti-shedding power cable plug according to the present invention.
Figure 9:
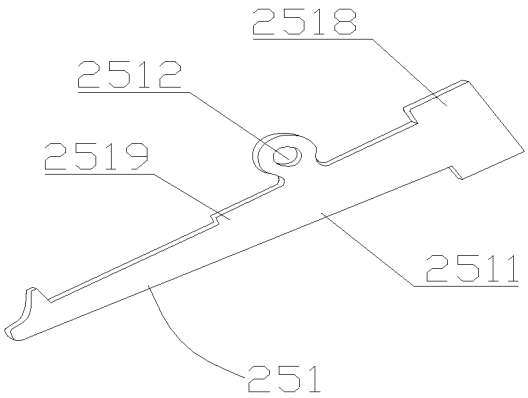
FIG. 9 is a structural schematic diagram of another preferred embodiment of the anti-shedding hook for the anti-shedding power cable plug according to the present invention.
Figure 10:
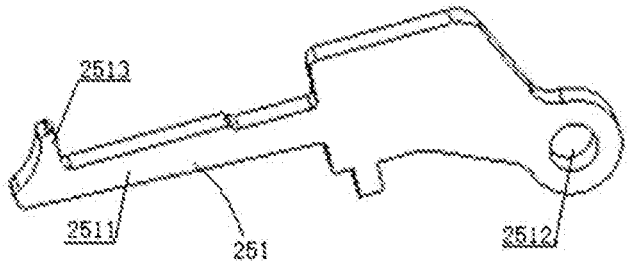
FIG. 10 is a structural schematic diagram of yet another preferred embodiment of the anti-shedding hook for the anti-shedding power cable plug according to the present invention.

As shown in FIG. 8 to FIG. 10, the anti-shedding hook 251 includes an anti-shedding hook body 2511, a second rotation hole 2512 transversely disposed on the anti-shedding hook body 2511, and an anti-shedding hook protrusion 2513 disposed on the upper surface of the front end for the anti-shedding hook body 2511. The axis of the second rotation hole 2512 coincides with the axis of the first rotation hole 231.

Figure 2:
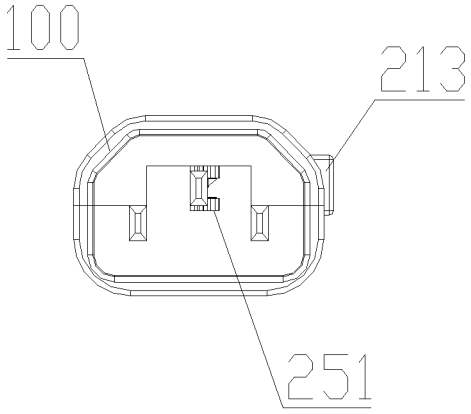
FIG. 2 is an arrangement diagram of a preferred embodiment of the first anti-shedding hook for the anti-shedding power cable plug according to the present invention.
Figure 3:
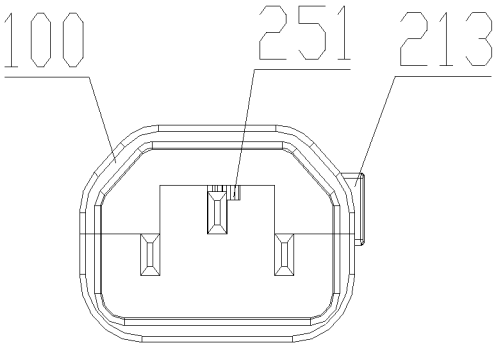
FIG. 3 is an arrangement diagram of a preferred embodiment of the second anti-shedding hook for the anti-shedding power cable plug according to the present invention.
Figure 4:
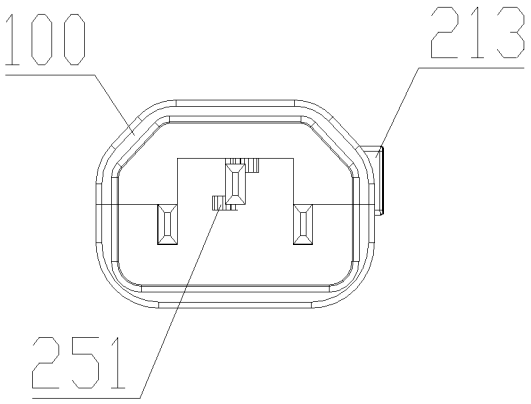
FIG. 4 is an arrangement diagram of a preferred embodiment of the third anti-shedding hook for the anti-shedding power cable plug according to the present invention.
Figure 5:
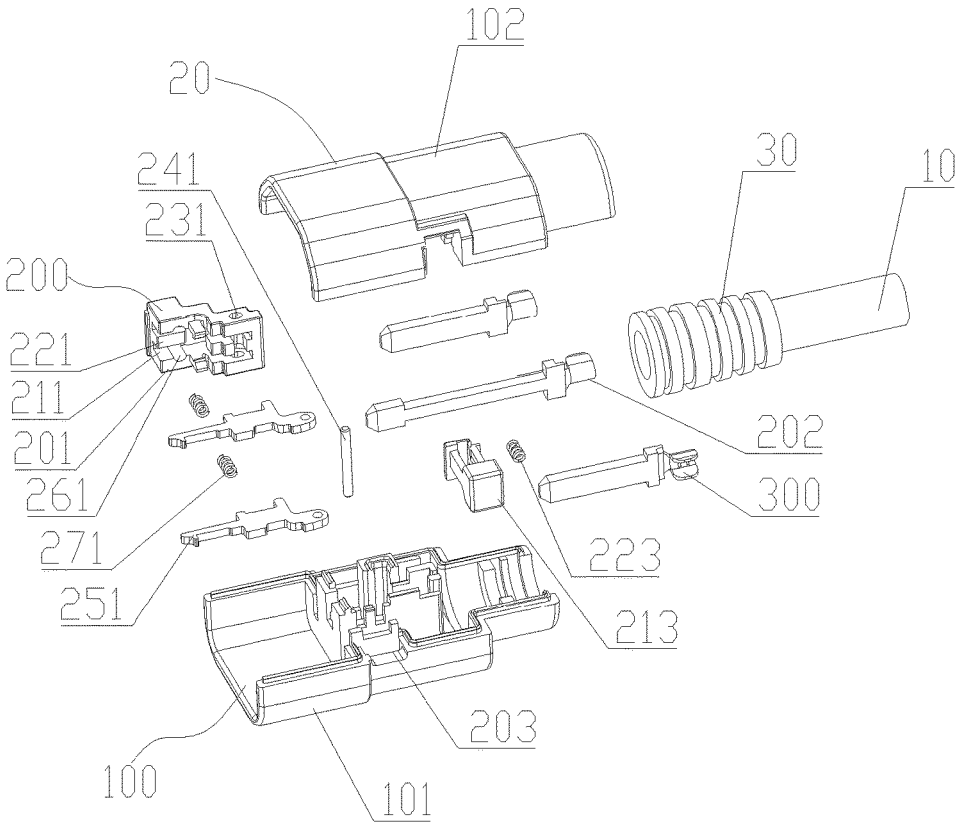
FIG. 5 is an exploded view of a preferred embodiment of the anti-shedding power cable plug according to the present invention.
Figure 6:
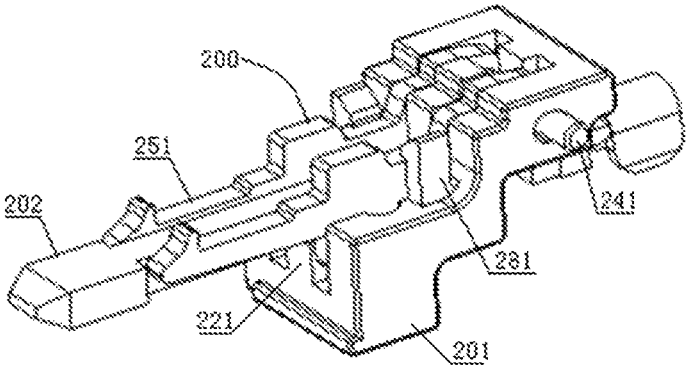
FIG. 6 is a structural schematic diagram of a preferred embodiment of the lock insert for the anti-shedding power cable plug according to the present invention.
Figure 7:
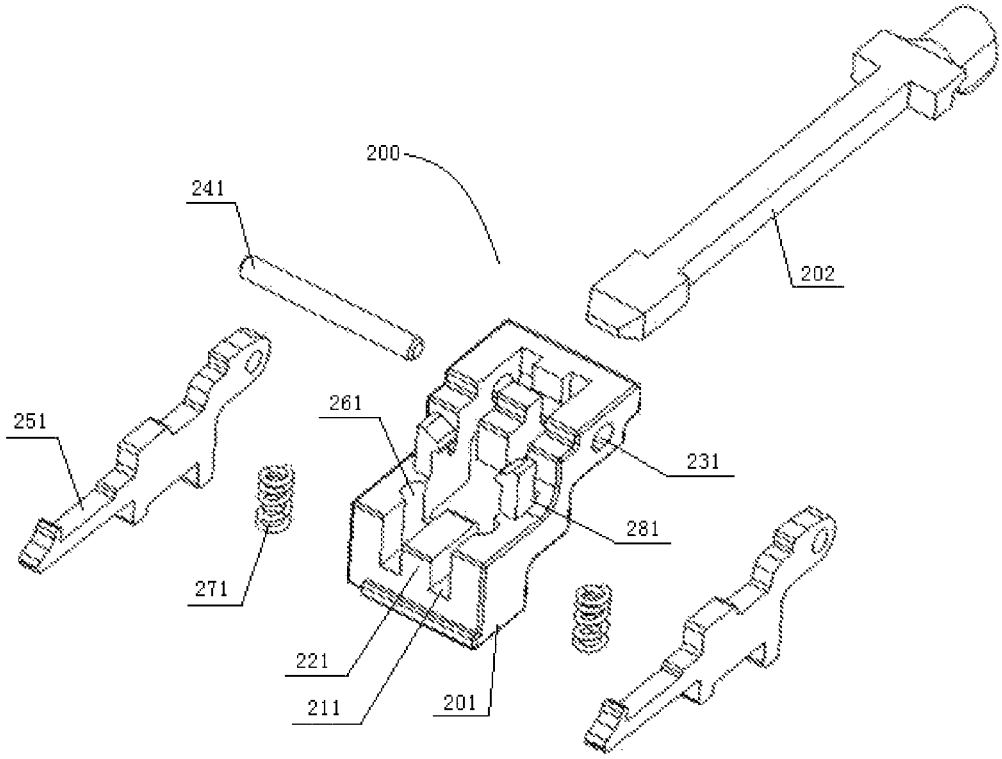
FIG. 7 is an exploded view of a preferred embodiment of the lock insert for the anti-shedding power cable plug according to the present invention.

Of course, the two anti-shedding hooks 251 may also be disposed on the same side. The hook opening of the anti-shedding hook protrusion 2513 has no preferred direction, and there is no quantity limitation on the anti-shedding hooks 251. A plurality of anti-shedding hooks 251 can be arranged as shown in FIG. 2-4. In FIG. 2, two anti-shedding hooks 251 are arranged on the same plane. In FIG. 3, only one anti-shedding hook 251 is arranged. And in FIG. 4, two anti-shedding hooks 251 are arranged on different planes.

As shown in FIG. 8, the second rotating hole 2512 is disposed at the rear end of the anti-shedding hook body 2511, and the axis of the second rotating hole 2512 is higher than the highest point of the anti-shedding hook protrusion 2513. Middle portion of the upper surface of the anti-shedding hook body 2511 is prominently provided with a first load-bearing position 2514, and a second load-bearing position 2515 is provided on a lower surface of the anti-shedding hook body 2511 corresponding to the first load-bearing position 2514. One end of the upper surface for the anti-shedding hook body 2511 that adjacent to the second rotation hole 2512 is provided with a third load-bearing position 2516, and a fourth load-bearing position 2517 is disposed on the left side of the second load-bearing position 2515.

As shown in FIG. 9, the second rotating hole 2512 is disposed at the middle portion of the upper surface for the anti-shedding hook body 2511, a fifth load-bearing position

2518 is disposed on the upper and lower surfaces of the rear end portion for the anti-shedding hook body 2511, and a sixth load-bearing position 2519 is arranged on the left side of the second rotation hole 2512.

As shown in FIG. 10, the second rotation hole 2512 is disposed at a rear end of the anti-shedding hook body 2511, the second rotation hole 2512 and the anti-shedding hook protrusion 2513 are disposed at upper and lower sides of the anti-shedding hook body 2511 respectively.

Figure 11:
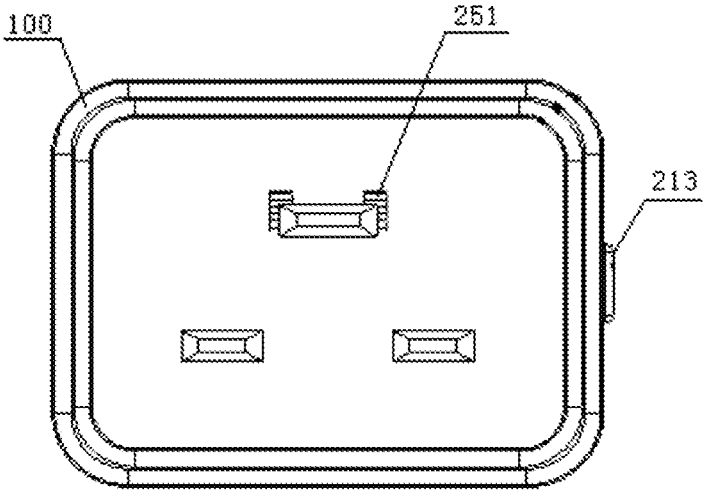
FIG. 11 is an application embodiment of the anti-shedding power cable plug C20 according to the present invention.

As shown in FIG. 11, the anti-shedding hook 251 provided by the preferred embodiment of the present invention can be applied to the C20 anti-shedding power cable plug.

The anti-shedding power cable plug provided by the present invention is applied to devices with high requirements on power supply, and to electric appliances and electronic products such as Al devices, servers, PDUs, ATMs and communication devices, so as to ensure reliable connections and no loosening of connections.

In conclusion, the present invention discloses an anti-shedding power cable plug, comprising a power cable and a plug body connected to one end of the power cable. The plug body includes a hollow housing, the housing includes a lower housing and an upper housing covered with the lower housing, and the housing accommodates a lock insert and conductive pins disposed on both sides of the lock insert. The lock insert includes an inner sleeve, a stepped groove is arranged in the middle of the inner sleeve, a supporting protrusion is arranged on the outer side of the stepped groove, a first rotating hole is arranged transversely on the inner side of the stepped groove. The first rotating hole is sheathed with a rotating shaft, the inner sleeve is sheathed with a ground pin, the ground pin is supported by the supporting protrusion. The ground pin is provided with an anti-shedding hook on its left and right sides, one end of the anti-shedding hook is sheathed on the rotating shaft, the inner sleeve is provided with a semicircular groove on each side wall adjacent to the two anti-shedding hooks, the two semicircular grooves accommodate a first return spring, the first return spring is pressed under the anti-shedding hooks. A button groove is arranged at a joint of the upper housing and the lower housing, and the button groove accommodates a key and a second return spring which is pressed under the key. The anti-shedding hook enables the power cable plug to be locked on the socket, thereby preventing the power cable from shedding during use so as to improve the reliability.

It should be understood that the application of the present invention is not limited to the above-described examples, and that those skilled in the art should recognize that modifications and variations are possible in the light of the above specifications, all such modifications and variations falling within the range of the appended claims.

We claim:

1. An anti-shedding power cable plug, comprising:

a power cable, and a plug body connected to one end of the power cable;

wherein the plug body comprises a hollow housing, the housing comprises a lower housing and an upper housing covered with the lower housing, the housing accommodates a lock insert and conductive pins disposed on both sides of the lock insert;

the lock insert comprises an inner sleeve, a stepped groove is arranged in the middle of the inner sleeve, a supporting protrusion is arranged on the outer side of the stepped groove, a first rotating hole is arranged transversely on the inner side of the stepped groove;

the first rotating hole is sheathed with a rotating shaft, the inner sleeve is sheathed with a ground pin, the ground pin is supported by the supporting protrusion;

the ground pin is provided with anti-shedding hooks on its left and right sides, one end of each of the anti-shedding hooks is sheathed on the rotating shaft, the inner sleeve is provided with a semicircular groove on each side wall adjacent to the two anti-shedding hooks, the two semicircular grooves accommodate a first return spring, the first return spring is pressed under the anti-shedding hooks;

a button groove is arranged at a joint of the upper housing and the lower housing, and the button groove accommodates a key and a second return spring which is pressed under the key.

2. The anti-shedding power cable plug according to claim 1, wherein one end of the housing that connected to the power cable is provided with a strain relief.

3. The anti-shedding power cable plug according to claim 1, wherein the anti-shedding hook comprises an anti-shedding hook body, a second rotation hole transversely disposed on the lock hook body, and an anti-shedding hook protrusion arranged on the upper surface of the front end for the anti-shedding hook body;

the axis of the second rotation hole coincides with the axis of the first rotation hole.

4. The anti-shedding power cable plug according to claim 3, wherein the second rotation hole is disposed at the rear end of the hook body, the axis of the second rotation hole is higher than the highest point of the anti-shedding hook protrusion;

middle portion of the upper surface of the anti-shedding hook body is prominently provided with a first load-bearing position, and a second load-bearing position is provided on a lower surface of the anti-shedding hook body corresponding to the first load-bearing position;

one end of the upper surface for the anti-shedding hook body that adjacent to the second rotation hole is provided with a third load-bearing position, and a fourth load-bearing position is disposed on the left side of the second load-bearing position.

5. The anti-shedding power cable plug according to claim 3, wherein the second rotating hole is disposed at the middle portion of the upper surface for the anti-shedding hook body, a fifth load-bearing position is disposed on the upper and lower surfaces of the rear end portion for the anti-shedding hook body, and a sixth load-bearing position is arranged on the left side of the second rotation hole.

6. The anti-shedding power cable plug according to claim 3, wherein the second rotation hole is disposed at the rear end of the hook body, the second rotation hole and the anti-shedding hook protrusion are respectively arranged on the upper and lower sides of the anti-shedding hook body.

* * * * *